US005138857A

United States Patent [19]

Siegert

[11] Patent Number: 5,138,857

[45] Date of Patent: Aug. 18, 1992

[54] DRAWING DEVICE IN A PRESS FOR DRAWING SHAPED SHEET-METAL PARTS

[75] Inventor: Klaus Siegert, Sindelfingen, Fed. Rep. of Germany

[73] Assignee: Maschinenfabrik Mueller-Weingarten AG, Weingarten, Fed. Rep. of Germany

[21] Appl. No.: 688,143

[22] Filed: Apr. 22, 1991

[30] Foreign Application Priority Data

Apr. 23, 1990 [DE] Fed. Rep. of Germany ..... 4012828

[51] Int. Cl.[5] ..... B21D 22/22

[52] U.S. Cl. ..... 72/19; 72/21

[58] Field of Search ..... 72/350, 351, 19, 21, 72/347, 453.13

[56] References Cited

U.S. PATENT DOCUMENTS

| | | | |
|---|---|---|---|
| 2,040,731 | 5/1936 | Ernst | 72/351 |
| 4,483,173 | 11/1984 | Duhamel | 72/351 |
| 4,489,584 | 12/1984 | Gall et al. | 72/350 |

FOREIGN PATENT DOCUMENTS

| | | | |
|---|---|---|---|
| 0074421 | 3/1983 | European Pat. Off. . | |
| 0173755 | 3/1984 | European Pat. Off. . | |
| 0401534 | 12/1990 | European Pat. Off. | 72/351 |
| 1040488 | 10/1958 | Fed. Rep. of Germany | 72/351 |
| 2400558 | 9/1974 | Fed. Rep. of Germany . | |
| 3242705 | 5/1984 | Fed. Rep. of Germany . | |
| 3431162 | 3/1986 | Fed. Rep. of Germany . | |
| 0018714 | 5/1971 | Japan | 72/350 |

*Primary Examiner*—David Jones

*Attorney, Agent, or Firm*—Spencer, Frank & Schneider

[57] ABSTRACT

A drawing device in a press is proposed which serves to draw shaped sheet-metal parts. In order to achieve optimum force support of the sheet holder (6), the pressure cheek (8) is regulated in a vertically adjustable manner by a four-point control system known per se. In addition to this, vertically adjustable bolts (7) having drives (15) are provided, in order to permit a specific local application of force to the sheet holder (6). This is controlled or regulated by displacement sensors (16) and force sensors (17).

6 Claims, 1 Drawing Sheet

DRAWING DEVICE IN A PRESS FOR DRAWING SHAPED SHEET-METAL PARTS

BACKGROUND OF THE INVENTION

1. Field of the Invention

The invention relates to a drawing device in a press for drawing shaped sheet-metal parts and, more particularly, providing variable and reproducible support of the sheet-metal holder as may be required during a drawing operation.

2. Description of the Related Art

Known hydraulic drawing devices for presses for drawing shaped sheet-metal parts generally consist of a top, vertically movable drawing ram as a top tool part and a bottom drawing punch, resting in a stationary position on a press table, as a bottom tool part, between which the shaped sheet-metal part to be formed is inserted. In order to avoid cracking in the wall or folds or corrugations in the surface structure of the workpiece, in particular in the case of workpieces of large area or also in the case of parts of complicated shape, this workpiece is held during the actual drawing operation by a drawing frame, holding-down device or sheet holder which surrounds the drawing punch in one piece or in several pieces. As apparent, for example, from EP 0,074,421, such a sheet holder is supported from below via a number of pressure bolts which are in turn supported relative to a vertically movable pressure plate, drawing cushion or pressure cheek. To this end, it has become known from DE 3,242,705 C2 from the applicant to regulate the pressure cheek in its vertical adjustment in its corner areas via a plurality of pressure-cylinder units, which can be regulated separately from one another, in order to apply a varying degree of force to the pressure bolts lying above them. In this way, the pressure cheek can be charged during the entire drawing process with locally varying, desired forces in any desired fine adjustment steps, with the pressure cheek further transmitting these forces by way of the pressure bolts to the sheet holder so as to adapt its contact pressure to the existing requirements.

The last-mentioned arrangement certainly permits good and partial support of the pressure cheek so that tilting can largely be avoided in the event of eccentric loading of the pressure cheek. However, the use of bolts of more or less the same length, which are inserted in a number corresponding to the requirement for the application of force to the sheet holder, has the disadvantage that these bolts can "dig" into both the sheet holder and the pressure cheek and may possibly additionally be compressed themselves. Reproducible relationships during refitting of the tool cannot as a rule be achieved in this way.

In order to avoid the use of insertable pressure bolts, it was therefore also proposed that the sheet holder be directly supported by a plurality of cylinder units arranged below it, which cylinder units act directly on the sheet holder by means of a separate pressure-displacement control or regulating system. In this arrangement, generally four cylinders were used which symmetrically support the sheet frame. Such an arrangement certainly has the advantage that accurate control or regulation of the application of force to the sheet holder is possible. However, the small number of cylinder units supporting the sheet holder has the disadvantage that the support itself is inadequate in certain areas and in the case of parts of complicated construction. Instead of four cylinders, a multiplicity of cylinders could certainly be arranged below the sheet holder in the press table. However, a spatial limit occurs here, since each cylinder has to be provided with a proportional valve control system so that a separate pressure-displacement control or regulating system can be realized. Furthermore, such a method would probably be very cost-intensive.

Furthermore, EP 0,173,755 A1 has disclosed a drawing device for a press according to the generic category of the present invention, in which drawing device a row of additional pressure-cylinder units is provided between pressure cheek and sheet holder. The pressure cheek itself is controlled in its vertical position by at least one pressure unit located below it. Both the individual pressure cylinders between pressure cheek and sheet holder and the pressure unit for the pressure cheek itself can be actively or passively subjected to a control or regulating system.

In this known device, the application of pressure to the sheet holder and thus the counterforce, acting from below, of the sheet holder against the drawing ram are effected essentially by the pressure-cylinder units arranged between sheet holder and pressure cheek. These pressure-cylinder units are in each case designed as stationary pressure cylinders having a continuous piston rod projecting on either side, the bottom part of the piston rod acting on the pressure cheek and the top part of the piston rod acting on the sheet holder. Passive regulation, generally provided, of the outflow of the pressure medium produces the desired counterholding force on the sheet holder, the counterholding force between sheet holder and top tool part during the drawing operation being produced solely by the pressure cylinders, arranged above the pressure cheek, upon appropriate activation. The pressure cheek of the known device, which pressure cheek can be acted upon centrally by pressure from below, performs a sequence of movements synchronously following the ram movement and serves on the one hand to raise the sheet holder into the position for inserting the workpiece and on the other hand to eject the workpiece into the transport plane. Locally varying support of this pressure cheek and application of force to the same is not provided during the drawing operation.

SUMMARY OF THE INVENTION

Compared with the known devices, the arrangement according to the invention has the advantage that various known systems are combined and are optimized by means of novel measures. Thus the invention on the one hand makes provision for the pressure cheek itself, during the entire drawing operation, to be acted upon in any fine coordination by forces required to a locally varying extent, so that this already makes possible control or regulation of the application of force to the sheet holder by the four-point control or regulating system known per se. Furthermore, provision is made for the counterholding force acting on the sheet holder to be additionally produced via vertically adjustable bolts which are supported on the pressure cheek, the bolts being distributed over the entire surface of the sheet holder and supporting the sheet holder from below according to the number required. In order to produce reproducible values with regard to any deformation of the bolts due to compression or any "digging" of the bolts both in the sheet holder and into the pressure cheek, or to eliminate their error effect, provision is made according to the invention for the bolts, provided with an additional drive, to be program-controlled in their vertical displaceability. The bolts are therefore not inserted according to their requisite length but are moved into position vertically by means of a separate drive in a program-controlled manner.

The drive is preferably constructed as a mechanically adjustable quill which is connected to the pressure cheek. In an advantageous further development of the invention, a force sensor is provided which senses the requisite supporting force per bolt, in the course of which each bolt movement can be effected in a force-regulated manner by means of a displacement infeed. Displacement measurement is provided at each bolt for this purpose.

BRIEF DESCRIPTION OF THE DRAWINGS

Further details and advantages of the invention are described in more detail in the description below and are shown in the drawing, in which.

DETAIL DESCRIPTION OF THE INVENTION

Figure 1:
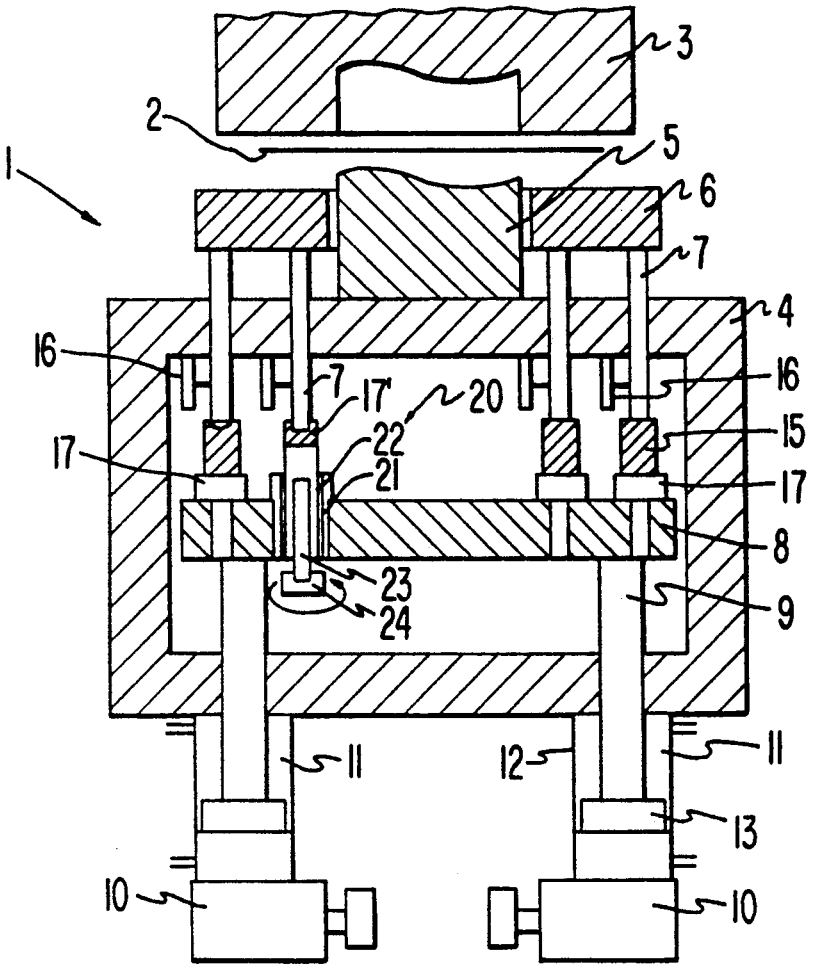
FIG. 1 shows a longitudinal section through the drawing device according to the invention.
Figure 2:
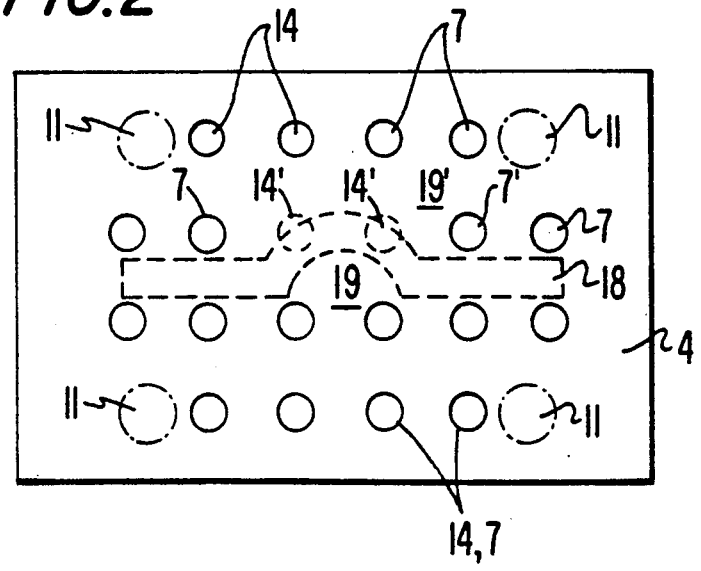
FIG. 2 shows a plan view of the press table with the arrangement of the pressure-cheek force-application points as well as the apertures for possible bolt arrangements.

The drawing device 1, shown simplified in FIG. 1, in a press serves to draw a shaped sheet-metal part 2. For this purpose, the press has a vertically movable top tool part 3 designed as a drawing ram 3 and a bottom tool part 5 resting on a stationary press table 4 and designed as a drawing punch 5. The drawing punch 5 is surrounded by a one-piece or multi-piece drawing frame 6 which is designed as a sheet holder 6 and fixes the shaped sheet-metal part 2 together with the associated encircling margin of the drawing ram 3 during the forming operation. The sheet holder 6 is connected non-positively to a pressure cheek 8 via a multiplicity of pressure bolts 7. The rectangular pressure cheek 8, also called drawing cushion, is supported in a vertically adjustable manner at its four corner areas by piston rods 9 of a pressure unit 11 which can be regulated by means of proportional valve 10. Provided for this purpose is a pressure cylinder 12 having a pressure piston 13, in which arrangement each of the four pressure units 11 (see FIG. 2) can be pressure-regulated individually and independently of one another. In this way, the pressure cheek 8 can be acted upon in any fine tuning by forces required to a locally varying extent and can thus be vertically adjusted to a varying extent in the corner areas. This arrangement of the pressure cheek control system is explained in DE 3,242,705 C2 from the applicant. The counterholding force, required during the drawing operation of the shaped sheet-metal part 2, between the sheet holder 6 and the drawing ram 3 is accordingly first of all produced on the pressure cheek by the pressure-regulating mechanism 11. This so-called four-point control or regulating system is constructed in such a way that the pressure cheek 8, on which the sheet holder 6 is supported via bolts 7, can be set individually in its four corner areas with regard to its vertical adjustment, the pressure units 11 being designed as lifting cylinders which can be controlled or regulated by pressure/displacement.

This regulating system is perfectly adequate in the case of shaped sheet-metal parts of geometrically simple shape. However, there are a multiplicity of workpieces for which such a four-point support is not sufficient, since the parts are designed eccentrically and asymmetrically. A rear longitudinal member 18 of a passenger car is shown, for example, by dashed lines in FIG. 2, which longitudinal member 18 would be inadequately supported in the crosshatched area 19, 19' by a four-point bearing of the pressure units 11. In accordance with the representation according to FIG. 2, therefore, the invention makes provision for the press table 4 to be provided with a close-meshed matrix network having through-holes 14 for the bolts 7, which support the sheet holder 6 at a multiplicity of locations. In this way, the sheet holder 6 can be set very close to the drawing punch 5 and the sheet-metal part can be supported in a directly adjacent manner on the drawing punch. The press table 4 shown in plan view in FIG. 2 therefore contains a close-meshed network of through-holes 14 for the pressure bolts 7, which surround the drawing punch 5 in a closely adjacent manner. In the exemplary embodiment, only the two holes designated by 14' are not occupied by bolts 7.

According to the invention all bolts 7 are provided with an additional drive 15 which ensures vertical displaceability of the respective bolt 7. The bolts 7, on which the sheet holder 6 is supported, are therefore not inserted as usual but can be retracted or extended in a program-controlled manner according to tool form. For this purpose, a displacement sensor 16 is provided at each bolt 7 or at each drive unit 15, which displacement sensor 16 senses the extended bolt length in the most accurate manner.

In order to ensure that the sheet holder 6 is loaded with the necessary supporting force per bolt, each bolt 7 is additionally provided with a force sensor 17 which permits a force-regulated displacement infeed of the individual bolts 7. The force sensor 17 can be arranged between the drive 15 and the pressure cheek 8. In this way, in combination with the displacement-measuring device 16, any "digging" of a bolt 7 into the sheet holder or into the pressure cheek 8 is also avoided. Any compression of the bolts 7 can also be detected and compensated or avoided in good time. The displacement infeed of each bolt 7, when a certain force per bolt is preset, is effected in a control circuit and can be programmed in memory. In this way, developing on the basis of the four-point pressure-displacement control or regulating system, a point support suitable for the tool can be effected by controlling or regulating the force per bolt.

Thus the preconditions for a reproducible press operation also exist, since it can be ensured that the tool, when being refitted, can be supported uniformly or as required, as was the case, for example, in the preceding forming operation, by setting the pressure-displacement variations not only at the four corner points of the pressure units 11 but also by setting the individual forces per bolt 7 or the approach distances per bolt 7 in accordance with the values which can be retrieved from the program memory.

It would also be possible not to provide all pressure bolts 7 with additional drives 15 but merely where an additional action of force of the bolts 7 is desired. This can be carried out very easily with the invention, since the drive units 15 can alternatively also be omitted and the bolts in this case can be inserted in the conventional manner.

The drive for the bolt 7 can in each case be designed as a mechanically adjustable quill 20 on which the pressure bolt is supported. In this arrangement, a nut 21 is let into the pressure cheek 8, in which nut 21 the quill 20, with thread 22, moves in a vertically adjustable manner. The quill is adjusted in the axial direction by motor-driven rotation of a multiply splined shaft 23. In the process, the accurate positioning of the quill 20 is effected by a regulated stepping motor 24 having an appropriate reduction gear. In this case, the pressure sensor 17' can be arranged between drive quill 20 and pressure bolt 7. Hydraulic vertical adjustment of the pressure bolts can of course also be provided.

The invention is not restricted to the exemplary embodiment shown and described. On the contrary, it also comprises all further developments and modifications of the basic idea according to the invention by persons skilled in the art.

I claim:

1. A drawing device for drawing shaped sheet-metal parts, comprising:

a drawing ram;

a drawing punch disposed opposite said drawing ram and having a perimeter, said drawing ram and said drawing punch being mounted for relative movement toward and away from one another;

a drawing frame sheet metal holder surrounding the perimeter of said drawing punch and having an upper surface for holding a sheet metal part against said drawing ram during a drawing operation and a bottom surface;

a pressure cheek for supporting the bottom surface of said sheet metal holder;

a plurality of individually adjustable pressure units each disposed in a respective corner area of said pressure cheek for individually vertically adjusting said pressure cheek during a drawing operation of a sheet metal part; and a plurality of vertically adjustable pressure devices disposed between said bottom surface of said sheet metal holder and said pressure cheek, said pressure devices each for transmitting forces generated by said plurality of individually adjustable pressure units to said sheet metal holder and each said pressure device including drive means for providing a supplemental force upon the bottom surface of said sheet metal holder during a drawing operation.

2. A drawing device as recited in claim 1, wherein said pressure devices each comprise a drive supported on said pressure cheek and a pressure bolt arranged above said drive and vertically movable by said drive for varying the length of said pressure bolt extending between said pressure cheek and the bottom surface of said sheet metal holder.

3. A drawing device as recited in claim 2, and further comprising:

displacement sensors located in proximity to said pressure bolts for sensing a change in bolt length and a force sensor disposed between each of said pressure bolts and said pressure cheek for measuring the force upon each bolt during a drawing operation.

4. A drawing device as recited in claim 1, and further comprising a press table for supporting said drawing punch, wherein said bolts are arranged in a close-meshed matrix network and said press table has a corresponding through hole pattern for the passage of said pressure bolts to the bottom surface of said sheet metal holder.

5. A drawing device as recited in claim 2, wherein said pressure bolts are arranged so as to affect at least a portion of the bottom surface of said sheet metal holder.

6. A drawing device as recited in claim 2, wherein said drive comprises a nut fixed to said pressure cheek, a mechanically adjustable quill supporting said pressure bolt and rotatably mounted in said nut and a servomotor electromechanically connected to said quill for vertically adjusting said quill.

* * * * *